United States Patent [19]

Howle

[11] 3,997,469

[45] Dec. 14, 1976

[54] CORROSION INHIBITION WITH OIL SOLUBLE DIAMIDES

[75] Inventor: Charles L. Howle, Houston, Tex.

[73] Assignee: Nalco Chemical Company, Oak Brook, Ill.

[22] Filed: Feb. 26, 1975

[21] Appl. No.: 553,094

[52] U.S. Cl. ..... 252/392; 21/25 R; 21/2.7 R; 106/14; 208/47; 252/8.55 E; 252/34; 252/51.5 A

[51] Int. Cl.[2] ..... C23F 11/14

[58] Field of Search ..... 252/392, 34, 51.5 A, 252/8.55 E; 21/2.7 R, 2.5 R; 106/14; 208/47

[56] References Cited

UNITED STATES PATENTS

| | | | |
|---|---|---|---|
| 2,598,213 | 5/1952 | Blair | 252/8.55 E |
| 3,378,581 | 4/1968 | Hummel | 252/392 |
| 3,458,453 | 7/1969 | Kautsky | 252/392 |
| 3,526,661 | 9/1970 | Hu | 252/392 |
| 3,765,850 | 10/1973 | Badin et al. | 252/392 |

*Primary Examiner*—Benjamin R. Padgett
*Assistant Examiner*—Irwin Gluck
*Attorney, Agent, or Firm*—Johnston, Keil, Thompson & Shurtleff

[57] ABSTRACT

Hydrocarbon liquids having a pH greater than 7 are inhibited against corrosion by the addition thereto of a corrosion inhibiting amount of a diamide or mixture of diamides of 1,3-dipropylene triamine and one or more organic monocarboxylic acids containing a sufficient number of carbon atoms to render said diamide or mixture of diamides oil soluble and water insoluble.

8 Claims, No Drawings

CORROSION INHIBITION WITH OIL SOLUBLE DIAMIDES

BACKGROUND

Corrosion of metal pipes and other equipment in contact with corrosive hydrocarbon liquids having a pH greater than 7 especially where such liquids contain hydrogen sulfide and other corrosive sulfur compounds is a problem in the handling of such liquids, particularly in refining operations including catalytic cracking and other petroleum refining operations.

Various types of corrosion inhibitors have been suggested for the purpose of preventing or inhibiting corrosion of steel and other ferrous metal pipelines and equipment which come into contact with the corrosive hydrocarbon liquids.

OBJECTS

One of the objects of the present invention is to provide improved corrosion inhibition of corrosive hydrocarbon liquids by the use of an inhibitor which is effective when such liquids have a pH greater than 7 and which also has a relatively wide range of effectiveness at varying temperatures from ambient temperatures to 100° C. and even higher.

Another object of the invention is to provide new and useful hydrocarbon liquids which are inhibited against corrosion.

A further object of the invention is to provide new and useful chemical compositions which are effective for inhibiting corrosion in corrosive hydrocarbon liquids at pH's above pH 7 and which may be useful for other purposes. Other objects will appear hereinafter.

BRIEF SUMMARY OF THE INVENTION

Hydrocarbon liquids having a pH greater than 7 are inhibited against corrosion by the addition thereto of a corrosion inhibiting amount of a diamide or mixture of diamides of 1,3-dipropylene triamine and one or more organic monocarboxylic acids containing a sufficient number of carbon atoms to render said diamide or mixture of diamides oil soluble and water insoluble.

The preferred corrosion inhibitor for the purpose of the invention is a diamide of 1, 3-dipropylene triamine and naphthenic acid which has been found to be especially useful for the inhibition of corrosion in ferrous metal pipelines used to carry hydrocarbon liquid effluents from catalytic cracking units employed for the catalytic cracking of petroleum hydrocarbons to make gasoline and other petroleum fractions.

DETAILED DESCRIPTION OF THE INVENTION

The corrosion inhibiting compositions prepared and used in accordance with the invention are characterized particularly by the fact that a diamide or mixture of diamides is derived from 1,3-dipropylene triamine to produce a compound or mixture of compounds containing two 3-carbon atom linear chains centrally connected by a nitrogen atom and having the terminal amino groups converted to amido groups by reaction with two moles per mole of amine of a monocarboxylic acid of a hydrocarbon in which there are a sufficient number of carbon atoms suitably arranged to produce a compound or mixtures of compounds which are oil soluble and water insoluble and have the following general formula:

$$R_2 . \underset{\underset{O}{\|}}{C} . \overset{H}{N} . CH_2 . CH_2 . CH_2 . \overset{H}{N} . CH_2 . CH_2 . CH_2 . \overset{H}{N} . \underset{\underset{O}{\|}}{C} . R_1$$

wherein $R_1$ and $R_2$ represent hydrocarbon groups preferably containing 5 to 19 carbon atoms and especially those hydrocarbon groups found in naphthenic acid.

Naphthenic acid is a natural constituent of petroleum which occurs in varying amounts usually from 0.1% to 3% by weight in various types of petroleum oils and is extracted by treatment with caustic alkalis as a usual part of the refining operations. As reported by Fieser and Fieser, Advanced Organic Chemistry, Reinhold Publishing Corporation 1963, pages 247–248, naphthenic acid is a mixture of monocarboxylic acids including cyclopentane-carboxylic acid, cyclopentylacetic acid, 3-methylcyclopentyl acetic acid, camphonanic acid, 4-methylcyclohexane-carboxylic acid and 2,2,6-trimethylcyclohexane-carboxylic acid.

The preparation of the diamides is carried out in a conventional manner by heating the 1,3-dipropylene triamine with the monocarboxylic acid using a molar ratio of two moles of acid to one mole of amine at temperatures above the boiling point of water with the elimination of water formed during the reaction. The resultant product is then diluted with a solvent such as kerosene or other suitable solvent which is compatible with the hydrocarbon system in which it is used. The diamide can be used as a 100% active material but dilution is usually desirable because only small amounts are required for corrosion inhibition.

A dosage as low as one part per million (ppm) of a 100% active material has been shown to be effective for corrosion inhibition in corrosive hydrocarbon liquids at a pH greater than 7 for some applications. Under more severe conditions a higher concentration may be necessary to give the desired degree of protection. In most cases a dosage of 10–20 ppm is entirely adequate and usually not more than 40 ppm will be required to obtain maximum effectiveness.

The diamide or mixture of diamide employed in accordance with the invention to inhibit corrosion is effective over a lower range of temperatures from ambient temperature of 25° C. to 100° C. and will not break down at temperatures even as high as 300° C. However, at higher temperatures the amount of protection will be more dependent upon the amount of diamide present, how it is applied and the kinetic effects of temperature on the surface film.

The preparation and use of the compositions of the invention will be further illustrated but is not limited by the following example.

EXAMPLE

Two moles of naphthenic acid were heated with one mole of 1,3-dipropylene triamine with stirring to a temperature of 230° C. and with removal of the water formed by the reaction. The solution was cooled to 160° C. and a vacuum of 25 inches of mercury was applied. The temperature was then raised to 230° C. and maintained for 2 hours. The resultant product was diluted to a 20% concentration using kerosene as the solvent.

A product was prepared as described in the foregoing example and was tested comparatively with other corrosion inhibitors in order to determine its effectiveness as compared with such inhibitors when added to a petroleum hydrocarbon liquid obtained from a catalytic cracking process in contact with steel of the type used in pipelines in refineries where catalytic processes are normally conducted. The corrosion rates of the metal in mils per year were determined for various quantities of the additives with the results shown in the following table where A is an imidazoline inhibitor obtained by the reaction of 1,2-dipropylene triamine and naphthenic acid, B is an imidazoline inhibitor obtained by the reaction of diethylene triamine and naphthenic acid, and C is a diamide of 1,3-dipropylene triamine and naphthenic acid obtained as described in the foregoing example:

| | Corrosion Rates in Mils/year | | | | | | |
|---|---|---|---|---|---|---|---|
| Concentration | 0 ppm | 5 ppm | 10 ppm | 15 ppm | 20 ppm | 30 ppm | 40 ppm |
| A | 95 | 95 | 92 | 89 | 79 | 50 | 15 |
| B | 87 | 85 | 85 | 80 | 15 | 10 | — |
| C | 110 | 12 | 13 | — | — | — | — |

From the foregoing table it will be seen that inhibitor A at a concentration of 5 ppm gave a corrosion rate of 95 mils per year, inhibitor B at the same concentration gave a corrosion rate of 85 mils per year, and inhibitor C at the same concentration gave a corrosion rate of 12 mils per year. Thus, the inhibitor of the present invention was 7 to 8 times more effective at the same dosage as inhibitors A and B. Inhibitor A required a dosage of 40 ppm to attain approximately the same effectiveness as that obtained by the inhibitor of the present invention at a dosage of 5 ppm. Inhibitor B required a dosage of 20 ppm to obtain approximately the same effectiveness as that obtained by the inhibitor of the present invention with a dosage of 5 ppm.

Inasmuch as all three inhibitors were derived from naphthenic acid, it would appear that the use of the 1,3-dipropylene triamine is a key factor coupled with the fact that products A and B had an imidazoline chemical structure. While naphthenic acid is the preferred carboxylic acid component of the diamide, other long chain acids can be used provided the resultant product is oil soluble and water insoluble. Examples of such other acids are those containing 8 to 18 carbon atoms derived from vegetable oils including higher fatty acids containing 8, 9, 10, 11, 12, 13, 14, 15, 16, 17 and 18 carbon atoms which may be saturated, e.g., lauric and stearic acid or unsaturated, e.g., oleic acid as well as mixtures of such acids.

The invention is applicable to the treatment of various types of petroleum products including aviation gasoline having an approximate boiling range of 90°–300° F., motor gasoline having an approximate boiling range of 90°–400° F., precipitation naphtha having a boiling range of 122°–266° F., painters naphtha having a boiling range of 210°–325° F., Stoddard solvent having a boiling range of 300°–400° F., kerosene having a boiling range of 350°–550° F., fuel oil having a boiling range of 400°–600° F., refinery gas oil having a boiling range of 400°–750° F., mineral seal oil having a boiling range of 500°–675° F. and transformer oil having a boiling range of 550°–750° F. However, the invention is especially useful in the treatment of hydrocarbon liquids obtained by catalytic cracking where the oil contains some sulfur and added hydrogen tends to produce hydrogen sulfide which is highly corrosive. Many hydrocarbon liquids which can be characterized as "sour" hydrocarbon liquids can be effectively treated to inhibit corrosion in accordance with the invention.

The invention is hereby claimed as follows:

1. A process of inhibiting corrosion of metals in contact with liquid petroleum hydrocarbons having a pH in excess of 7 which comprises adding to said hydrocarbons a corrosion inhibiting amount of a diamide or mixture of diamides which is the product of the reaction of 1,3-dipropylene triamine and one or more organic monocarboxylic acids containing a sufficient number of carbon atoms to render said diamide or mixture of diamides oil soluble and water insoluble.

2. A process as claimed in claim 1 in which the petroleum hydrocarbons contain corrosive amounts of sulfur.

3. A process as claimed in claim 1 in which said diamide is a diamide of petroleum naphthenic acids and 1,3-dipropylene triamine.

4. Hydrocarbon liquids having a pH greater than 7 inhibited against corrosion by the addition thereto of a corrosion inhibiting amount of a diamide or mixture of diamides which is the product of the reaction of 1,3-dipropylene triamine and one or more organic monocarboxylic acids containing a sufficient number of carbon atoms to render said diamide or mixture of diamides oil soluble and water insoluble.

5. Hydrocarbon liquids as claimed in claim 4 in which said hydrocarbon liquids contains corrosive amounts of sulfur.

6. Hydrocarbon liquids as claimed in claim 4 in which said diamide is a diamide of petroleum naphthenic acids and 1,3-dipropylene triamine.

7. A diamide or mixture of diamides which is the product of the reaction of 1,3-dipropylene triamine and one or more organic monocarboxylic acids containing a sufficient number of carbon atoms to render said diamide or mixture of diamides oil soluble and water insoluble, said diamide having the general formula $$R_2 . \underset{\underset{O}{\|}}{C} . \overset{H}{N} . CH_2 . CH_2 . CH_2 . \overset{H}{N} . CH_2 . CH_2 . CH_2 . \overset{H}{N} . \underset{\underset{O}{\|}}{C} . R_1$$

wherein $R_1$ and $R_2$ are hydrocarbon radicals containing 5 to 19 carbon atoms.

8. A diamide or mixture of diamides as claimed in claim 7 wherein $R_1$ and $R_2$ are hydrocarbon radicals of naphthenic acid.

* * * * *